United States Patent [19]

Peleschka et al.

[11] 4,255,058

[45] Mar. 10, 1981

[54] APPARATUS FOR PREPARING BITUMINOUS MIXTURES, ESPECIALLY ROAD CONSTRUCTION MIXTURES

[75] Inventors: Gerhart Peleschka, Westerngrund-Oberwestern; Dieter Sallmann, Gruendau-Rothenbergen, both of Fed. Rep. of Germany

[73] Assignee: WIBAU Industrie und Verwaltung GmbH, Gruendau, Fed. Rep. of Germany

[21] Appl. No.: 50,306

[22] Filed: Jun. 20, 1979

[51] Int. Cl.[3] ..... B28C 5/46

[52] U.S. Cl. ..... 366/25; 366/228

[58] Field of Search ..... 366/22, 23, 24, 25, 366/18, 16, 17, 19, 7, 54, 56, 57, 58, 59, 220, 225, 227, 228

[56] References Cited

U.S. PATENT DOCUMENTS

| | | | |
|---|---|---|---|
| 2,631,827 | 3/1953 | Saxe | 366/18 |
| 3,809,373 | 5/1974 | Brock | 366/18 |
| 4,039,171 | 8/1977 | Shearer | 366/25 |
| 4,095,285 | 6/1978 | Malbrunot | 366/23 |
| 4,165,184 | 8/1979 | Schlarmann | 366/24 |

*Primary Examiner*—Robert W. Jenkins

*Attorney, Agent, or Firm*—W. G. Fasse; D. F. Gould

[57] ABSTRACT

The present apparatus for preparing bituminous mixtures, especially road construction mixtures which include broken-up road material, uses a kiln type drum through which the introduced heat and the mixture components travel in the same direction from an inlet to an outlet. Between the inlet and outlet there are five zones, namely, a feed-in zone, a mixing zone, a uniformalizing zone, a lifting and dropping zone, and a discharge zone with separate exits for vapors or gasses on the one hand, and for the finished mixture on the other hand. The uniformalizing zone is formed by overlapping components of the mixing zone and components of the lifting and dropping zone.

7 Claims, 4 Drawing Figures

FIG. 3
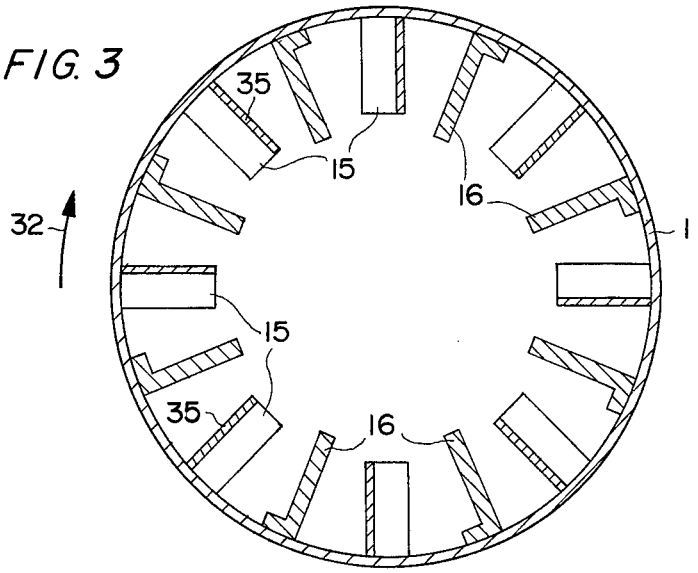
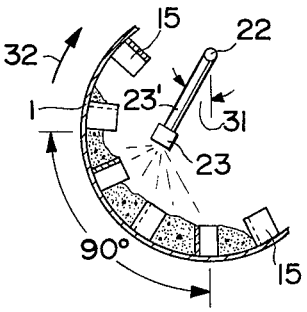
FIG. 2
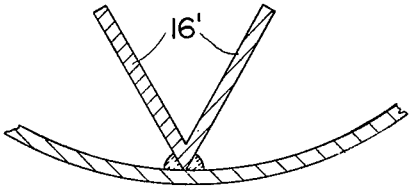
FIG. 4

APPARATUS FOR PREPARING BITUMINOUS MIXTURES, ESPECIALLY ROAD CONSTRUCTION MIXTURES

BACKGROUND OF THE INVENTION

The present invention relates to an apparatus for preparing bituminous mixtures, especially road construction mixtures which include broken-up road material.

The present type of apparatus is used for mixing, heating, and drying aggregate and bituminous binder components preferably in a continuous manner. However, this type of apparatus is also suitable for the batch type preparation of bituminous mixtures. The mineral aggregates still comprise a certain moisture proportion when they are supplied into the apparatus whereby dust production is minimized. Such devices comprise a kiln type rotary drum through which the components of the mixture and the heat travel in the same direction from a feed-in end to a discharge end. The rotary drum is divided into several zones constructed for different purposes. German Pat. No. 2,102,328 first published on Aug. 3, 1972 and granted on Sept. 30, 1975 discloses an apparatus of the just described type.

These mixing devices have been found to be very practical. However, in those instances where the aggregate comprises components obtained from breaking up the surface of roads that require repairs, the just described apparatus leaves room for improvement. It has been found that the prior art structure does not distribute the broken-up road components such as broken-up road surface layers and broken-up road binder layers in a sufficiently uniform manner. However, the success of reusing broken-up road material as a component in the new mixture depends on the uniform distribution of the broken-up material throughout the volume of the new mixture.

German Pat. No. 1,594,815 describes an apparatus for mixing heating and drying bituminous mixtures in a continuous or batch type operation. In this apparatus the mineral aggregate components also still comprise some moisture at the time of joining these mineral components with the bituminous binder material. In this known apparatus the non-dried mineral components and the binder components are mixed until a sufficient statistic distribution of the binder components on the surfaces of the mineral components has been achieved. Thereafter the so premixed material is supplied into a dryer where it is sufficiently heated. This type of heating requires a careful classification of the individual fractions of the aggregate components, each of which requires its particular moisture content for the successful mixing of the total mineral components with the bituminous binder components.

The apparatus of German Pat. No. 1,594,815 is suitable for the batch type mixing only. Further, the broken-up road material added to the aggregate includes already bituminous binder material which is not sufficiently plastified at the time of mixing with the new aggregate components. Therefore, there is the possibility that once the binder material in the broken-up road material becomes plastified there may be formed zones which have too much binder material. The accumulation of undesirably high proportions of binder material in certain zones of the mixture is due to the fact that the binder material of the broken-up aggregate component combines with the freshly added binder material in such zones. The accumulation of excessive binder material is undesirable because it hinders the transport of the premixed material to the dryer by sticking to the containers used for the intermediate transport. Thus, a demixing may prevent the desired uniform distribution of the mixture components throughout the volume of the mixture.

OBJECTS OF THE INVENTION

In view of the foregoing it is the aim of the invention to achieve the following objects singly or in combination:

to avoid the drawbacks of the prior art, specifically to avoid the use of a separate mixer and to allow for the successful addition of broken-up road material to the new mixture;

to improve an apparatus as described in German Pat. No. 2,102,328 in such a manner that it will be capable of reusing bituminous broken-up material obtained from road structures to be repaired and to assure that this broken-up material will be uniformly distributed throughout the volume of the new mixture;

to provide an apparatus of the above type with a uniformalizing zone between the mixing zone and the heating and drying zone; and to construct the uniformalizing or homogenizing zone in such a manner that it will make the broken-up material more homogeneous and distribute the broken-up material uniformly throughout the volume of the mixture along with any other added aggregates and binder components.

SUMMARY OF THE INVENTION

According to the invention there is provided an apparatus for preparing bituminous mixtures including a rotary drum having an inlet end and an outlet end and a plurality of zones in said rotary drum between the inlet and outlet. These zones include a feed-in zone for conveying the mineral aggregate and possibly additional bituminous broken-up material from the inlet proper into the interior of the rotary drum. The heating means also reach into this feed-in zone. The feed-in zone is followed by a mixing zone wherein bituminous binder components are added to the mixture of new and old aggregate, for example, by spraying. "Old Aggregate" here means broken-up road material. The mixing zone is conventionally followed by the so-called lifting and dropping zone which functions as a heating, drying, and enveloping zone. The last zone is the discharge zone. According to the invention a uniformalizing zone is operatively arranged between the mixing zone and the lifting and dropping zone. In the preferred embodiment the uniformalizing zone comprises components of the mixing zone and components of the lifting and dropping zone arranged in an overlapping relationship.

It has been found to be critical for the uniform distribution of the broken-up old road material in the new mixture, that the lifting and dropping elements cooperate with the elements of the mixing zone which have a tendency of shifting the mixture components radially inwardly. It would appear that the intensive movement of all the components that has been accomplished according to the invention by the cooperation of the mixing elements and the lifting and dropping elements the desired uniform distribution or homogenization is achieved which was not possible heretofore in devices in which the mixing zone did not overlap with the lifting and dropping zone.

It is also important that intensive movements for the uniform distribution take place in an area where the coating of the mineral aggregate components by the bituminous binder components is not yet completed.

BRIEF FIGURE DESCRIPTION

In order that the invention may be clearly understood, it will now be described, by way of example, with reference to the accompanying drawings, wherein:

FIG. 2 is a partial sectional view along section line 2—2 in FIG. 1;

FIG. 3 is a sectional view along section line 3—3 in FIG. 1 through the hybrid zone according to the invention; and FIG. 4 is a sectional view similar to that of FIG. 3 showing a modification of the longitudinal lifting and dropping elements.

Figure 1:
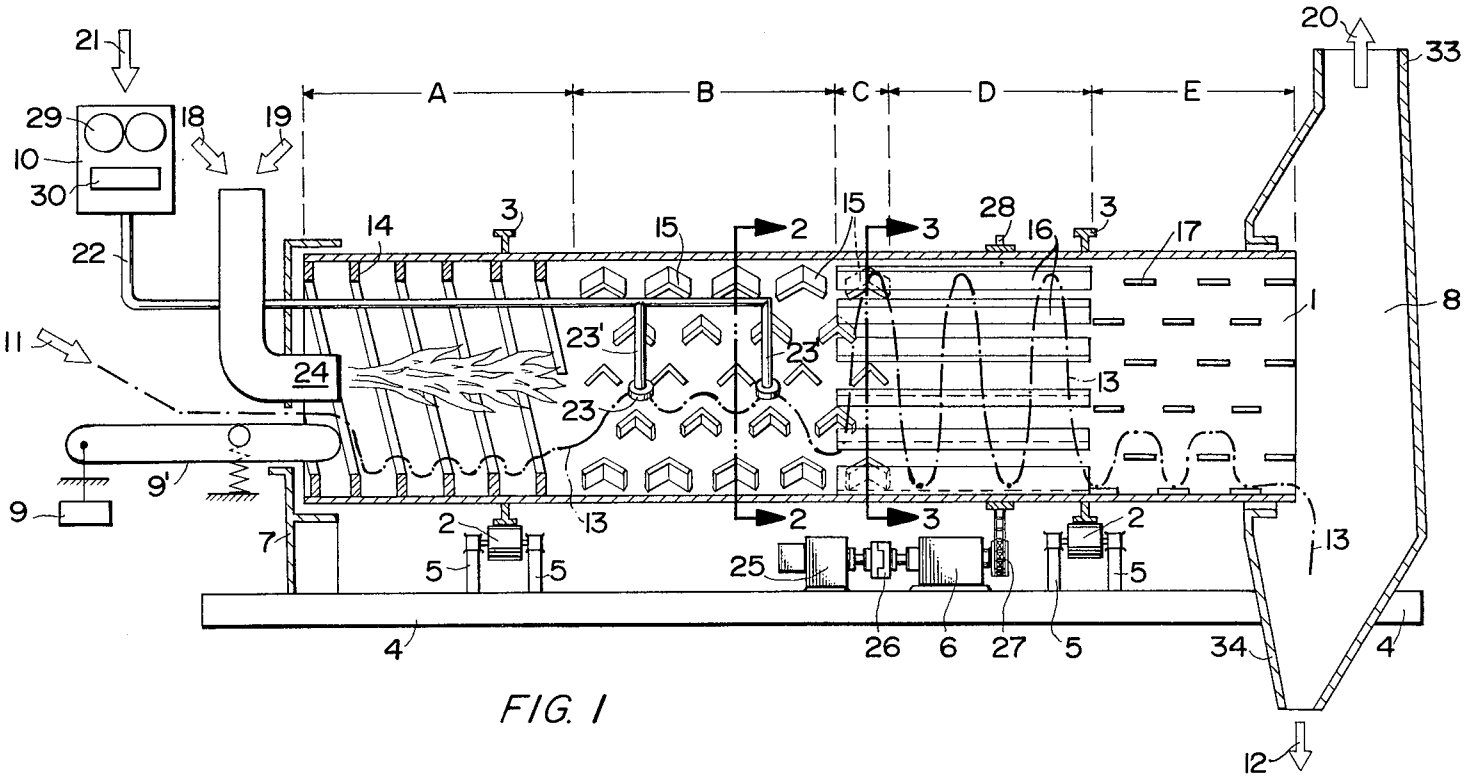
FIG. 1 is a somewhat schematic longitudinal sectional view through the rotary drum of a mixer according to the invention.

DETAILED DESCRIPTION OF PREFERRED EXAMPLE EMBODIMENTS AND OF THE BEST MODE OF THE INVENTION

FIG. 1 shows the rotary, kiln type drum 1 supported on bearing rollers 2 by means of bearing or runner rings 3 secured to the outer circumference of the drum 1. The bearing rollers 2 are supported on a base or foundation 4 by means of bearing blocks or shields 5 secured to the base 4. A motor 25 drives a gear box 6 through a clutch 26. The gear box has a power output member 27 which drives a spur gear 28 secured to the outer circumference of the drum 1. The power output means 27 may comprise a drive pinion directly meshing with the spur gears 28 or a chain drive may be interposed between the power output and the gear 28.

Ahead of the feed-in zone A of the drum 1 there is arranged a feed-in conveyor 9' cooperating with a conveyor scale 9 for determining the quantity of aggregate to be supplied in the direction of the arrow 11 into the feed-in zone A of the drum 1 through a respective opening in a housing member 7. Heat is supplied into the drum substantially axially by means of a flame nozzle 24 also extending through the housing wall 7. The flame nozzle 24 is supplied with fuel and combustion air as indicated by the arrows 18 and 19.

A bitumen supply dosing container 10 is operatively connected through conduit 22 to distributor nozzles 23. The conduit 22 also extends through a respective opening in the housing wall 7 and reaches all the way into the mixing zone B of the drum 1. The dosing container 10 receives the bitumen as indicated by the arrow 21 and is provided with adjustment means 29 as well as indicator means 30 for correlating the quantity of bitumen binder material to the quantity of aggregate indicated by the scale 9. This correlation may be accomplished by the operator by manual adjustment or it may be accomplished by automatic means well known in the art and not related to the invention.

The mixing zone B comprises a plurality of radially extending angle iron elements 15 also shown in FIGS. 2 and 3. The angle iron elements 15 are secured to the inner surface of the drum 1 for example, by conventional welding. As mentioned, the bitumen spray nozzle 23 reaches into the mixing zone B and the end pipe members 23' extend at an angle 31 relative to the vertical as best seen in FIG. 2. The angle 31 is preferably within the range of about 15° to about 45° and as viewed in the direction of rotation of the drum 1. Said direction of rotation is indicated by the arrow 32. The spray nozzles 23 distribute the bituminous mixture in fine droplets to prepare the enveloping of the aggregate material as it enters into the mixing zone B from the feed-in zone A through which it is transported by means of a helix 14 secured to the inner wall of the drum 1. The aggregate material is hardly heated in the feed-in zone and its temperature begins to rise in the mixing zone. The feed advance of the aggregate material and later on of the mixture is indicated by the dash-dotted line 13 which shows that the aggregate in the feed-in zone A mainly stays closed to the inner surface of the drum 1 in the channels formed by the sheet metal helix 14. The angle iron members 15 in the mixing zone raise the material radially inwardly as indicated by the dash-dotted line 13.

According to the invention a hybrid homogenization or uniformalizing zone C is operatively interposed between the mixing zone B and the lifting and dropping zone D in which the material takes up most of the heat for the proper coating and enveloping of the aggregate particles by the bituminous binder material. This lifting and dropping in the zone D is accomplished by means of longitudinal bars 16 also shown in FIG. 3. These bars 16 may be metal strips or sectional steel also welded to the inner surface of the drum.

These longtudinal bars 16 may have a trough shape 16' as shown in FIG. 4 to facilitate the raising of the material as the drum rotates, whereby the material is moved substantially all the way to the top of the drum in order to then drop down again to the bottom of the drum as the latter rotates. The lifting and dropping zone D is followed by a discharge zone E comprising radially inwardly directed steel bars 17 for thoroughly agitating the mixed and coated material to degas the latter. The gasses and vapors are removed as indicated by the arrow 20 and the mixture leaves the housing member 8 as indicated by the arrow 12. The member 8 forms a gas and vapor discharge stack 33 and a discharge funnel 34 for the mixed material.

The angle iron members 15 in the mixing zone B and in the hybrid zone C are arranged so that the ridge 35 of each member faces in the rotation direction 32 of the drum. This permits some lifting of the material and then discharging it radially inwardly into the mixing chamber. The angle iron members 15 have a radial length which depends on the diameter of the drum 1.

For drums having a diameter in the range of 1800 mm to 2200 mm the radial length of the members 15 should be within the range of 250 mm to 350 mm. For a drum of similar size the radial length of the longitudinal members 16 in the lifting and dropping zone D should be within the range of 230 mm to 370 mm. Incidentally, as seen in FIG. 2, the lifting by the elements or members 15 is mostly effective in the lower lefthand 90° sector of the circumference of the drum 1. Most of the material is turned over in the range of about 45° within the just mentioned sector. The angular position of the pipe ends 23' thus facilitates the mixing of the bituminous material and the aggregate.

Due to the overlap of the radially extending angle iron elements 15 and the axially extending lifting and dropping elements 16 in the hybrid zone C according to the invention, the broken-up old road material is further subjected to intensive handling which further reduces the size of the individual broken-up chunks so that their size becomes more uniform and simultaneously is more uniformly distributed throughout the volume of the mixture. The so homogenized mixture is then further uniformly distributed by the longitudinal elements 16 over the entire drum cross section in the zone D as indicated by the line 13 in this zone. This uniform distribution of the homogenized material exposes the maximum surface area to the heating gasses whereby the material is heated and dried and whereby the final enveloping of the mineral particles by the bituminous binder material takes place. The mixture is then degassed in the zone E as mentioned.

Incidentally, the radially extending elements 15 and the axially extending elements 16 as well as the radially extending elements 17 will be uniformly distributed over the inner surface of the drum 1.

Although the invention has been described with reference to specific example embodiments, it will be appreciated, that it is intended to cover all modifications and equivalents within the scope of the appended claims.

What is claimed is:

1. In an apparatus for preparing bituminous mixtures including a rotary drum having an inlet end and an outlet end and a plurality of zones in said rotary drum between said inlet end and said outlet end, said zones including a feed-in zone, a mixing zone, a lifting and dropping zone, and a discharge zone, the improvement comprising a uniformalizing zone operatively arranged between said mixing zone and said lifting and dropping zone, and wherein said feed-in zone comprises strip means (14) shaped to form a helix secured to the inner surface of said rotary drum, said strip means facing with a narrow edge substantially radially inwardly, said mixing zone comprising spraying jet means for supplying a bituminous binder component into said mixing zone and sectional angle iron members secured to the inner wall of said rotary drum so as to extend radially inwardly, said lifting and dropping zone comprising longitudinal members secured to the inner wall of said rotary drum and extending axially relative to said drum, said discharge zone comprising flat bars secured to the inner wall of said rotary drum and extending radially inwardly of said rotary drum, said uniformalizing zone comprising components of said mixing zone and components of said lifting and dropping zone arranged in an overlapping relationship.

2. The apparatus of claim 1, wherein said uniformalizing, overlapping zone has an axial length in the range of 350 mm to 500 mm.

3. The apparatus of claim 1, wherein said spraying jet means are arranged at an angle within the range of 15° to 45° relative to the vertical and as viewed in the direction of rotation of said drum.

4. The apparatus of claim 1, further comprising conveyor belt scale means (9, 9') for feeding and weighing aggregate and broken-up material into said rotary drum, and dozing means for supplying bituminous binder material into said drum, said dozing means being adjustable for coordinating the quantity of bituminous binder material to the quantity of aggregate and broken-up road material as determined by said conveyor belt scale means.

5. The apparatus of claim 1, wherein each of said zones has substantially the same axial length except said uniformalizing zone, said length being within the range of 1800 mm to 2500 mm.

6. The apparatus of claim 1, wherein said longitudinal members of said lifting and dropping zone have a trough shape.

7. The apparatus of claim 1, wherein said uniformalizing zone comprises said angle iron members and portions of said longitudinal members arranged in overlapping relationship relative to one another.

* * * * *